United States Patent [19]

Sirotkin

[11] Patent Number: 4,572,374

[45] Date of Patent: Feb. 25, 1986

[54] CONTAINER

[76] Inventor: Karl M. Sirotkin, 307 Colonial Rd., Knoxville, Tenn. 37920

[21] Appl. No.: 642,786

[22] Filed: Aug. 21, 1984

[51] Int. Cl.[4] ..... B65D 21/02; B65D 21/06

[52] U.S. Cl. ..... 206/518; 206/505; 206/515; 206/519

[58] Field of Search ..... 206/505, 515, 518, 519, 206/520, 508

[56] References Cited

U.S. PATENT DOCUMENTS

| | | | |
|---|---|---|---|
| 1,892,756 | 1/1933 | Van Horne . | |
| 1,910,924 | 5/1933 | Klefeker et al. . | |
| 2,596,443 | 5/1950 | Hunt . | |
| 2,606,586 | 8/1952 | Hill . | |
| 2,738,914 | 3/1956 | Hatch . | |
| 2,768,667 | 10/1956 | Hill . | |
| 2,774,511 | 12/1956 | Menkin | 206/507 |
| 3,104,044 | 9/1963 | Reifers . | |
| 3,383,009 | 5/1968 | Weikert . | |
| 3,739,939 | 6/1973 | Koenig . | |
| 3,841,528 | 10/1974 | Eisenberg | 206/515 |
| 3,900,106 | 8/1975 | Cantales | 206/519 |

FOREIGN PATENT DOCUMENTS

| | | | |
|---|---|---|---|
| 1448393 | 6/1966 | France | 206/520 |

*Primary Examiner*—George E. Lowrance

*Attorney, Agent, or Firm*—Luedeka & Neely

[57] ABSTRACT

A four-walled, open-topped container having a lid is disclosed in which the lid is insertable into the container for storage along and against one wall of the container. The lid for the container is generally planar and has a trapezoidal shape and the four walls of the container are generally planar, are interconnected, and are joined to a bottom. A rim for engaging the lid is defined by the upper ends of the four walls. The rim is trapezoidal in shape to conform to the lid and has long and short parallel opposed sides and two converging opposed sides. The four walls converge inwardly from the rim to the bottom to a sufficient degree to permit a container to nest within a like container. In addition, the convergence of the walls which define the opposed converging sides of the rim is appropriate to permit the lid to be inserted into the container along and against the wall defining the long parallel side of the rim. With a lid so inserted into a container, containers and lids are stackable in a space-saving, nested arrangement for storage and handling.

6 Claims, 13 Drawing Figures

CONTAINER

The present invention relates to nestable containers and more particularly relates to containers with lids which may be stacked in a nested arrangement together with their lids.

Many types of containers have been developed for various uses which are nestable to conserve space when the containers are not in use and to simplify the handling of multiple containers. Often such containers are designed as a set of similarly shaped containers of varied sizes so that the smaller containers fit inside the next larger sized container. Nestable containers of varied size generally have specialized uses where the number of the containers is limited and where varied size is a desired property, e.g., kitchen measuring cups. For applications where a large number of containers are to be used, it is generally necessary for nestable containers to be of uniform size. Generally, known nestable containers of uniform size taper from the opening into the interior of the container in order to receive a like container into the interior. Containers of this type have a wide variety of uses in food preparation and storage, for the packaging of various items for sale, for shipping and for many other uses.

When known nestable containers having a removable lid are stored, it is generally necessary to store the lids separately from the containers in order for the containers to be stacked in a nested arrangement. Separate storage of the lids gives rise to problems such as misplacing the lids for the containers, confusing the lids for one type container with lids for other types of containers, and providing for the collective storage and handling of lids. Often, it is necessary to employ additional packaging or even another container to house the lids. Typical of containers prone to such problems are the small sealable plastic containers having removable lids often used for food preparation and storage.

One attempt to solve these problems is disclosed in U.S. Pat. No. 3,383,009 which discloses nestable containers having hinged sealable lids. When nested, the lids hang downwardly and outwardly from the containers. The lids hanging on the side of the containers make handling of the containers difficult and some of the space gained by the nested stacking is lost to the space occupied by the lids extending at an angle outwardly from the containers. The tightness of nesting of the containers is thus limited because, as the containers are nested more tightly, the lids are forced outwardly by the next lower container in the stack causing the lids to occupy additional space.

Accordingly, a need has arisen for a nestable container with a removable lid in which the container may be stacked together with its lid when a plurality of like containers and lids are stacked in a nested arrangement. Moreover, a need has arisen for a nestable container having an attached lid which may be stacked in a space-saving, nested arrangement. The container of the present invention satisfies the above mentioned needs and solves other problems associated with known nestable containers.

In accordance with one form of the present invention, there is provided a four-walled, open-topped container and a generally planar lid having a generally trapezoidal shape. The lid is insertable into the container along and against one of the walls of the container for storage. The container has a bottom and four interconnected generally planar walls which define a generally trapezoidal-shaped rim proportioned to engage the lid and having long and short parallel opposed sides and two converging opposed sides. The walls of the container converge from the rim to the bottom to permit nesting of a container into a like container and the two walls defining the converging opposed sides of the rim converge to permit the lid to be inserted into the container along and against the wall defining the long parallel side. Containers with lids so inserted are stackable in a space-saving nested arrangement of containers and lids for storage and handling.

The present invention may best be understood by reference to the following detailed description when considered in conjunction with accompanying drawings in which.

Figure 1:
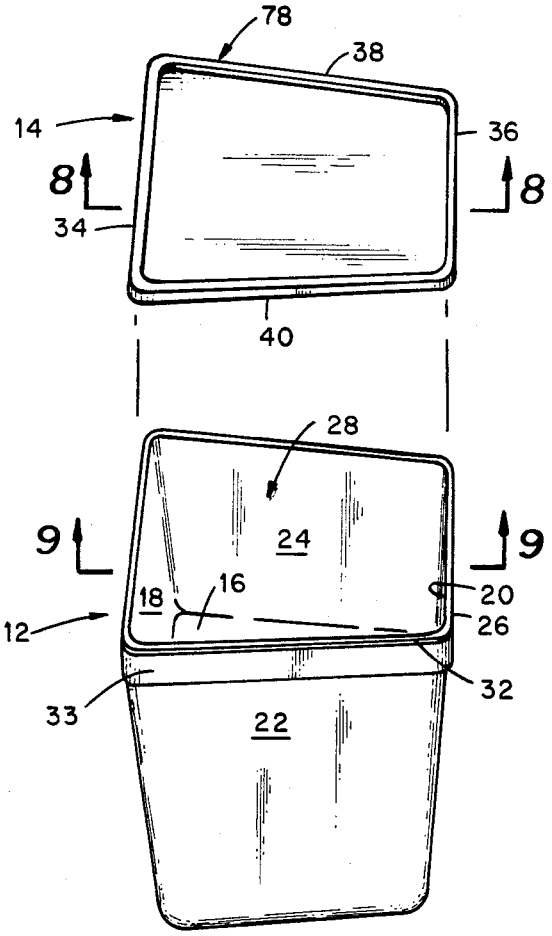
FIG. 1 is a perspective view of a container and lid embodying one form of the present invention showing the lid removed from the container.

Referring now to the drawings in which like reference characters designate like or corresponding parts throughout the several views, there is shown in FIG. 1 a perspective view of a container 12 and lid 14 embodying one form of the present invention. The container 12 has a generally planar bottom 16, firt and second generally planar end walls 18 and 20, respectively, and first and second generally planar side walls 22 and 24, respectively. The first and second end walls 18 and 20 and the first and second side walls 22 and 24 extend upwardly from the bottom 16 and their upper ends define a rim 26. The rim 26 provides an opening 28 into the container 12. The lid 14 is generally planar and is dimensioned to cover the opening into the container 12.

Figure 8:
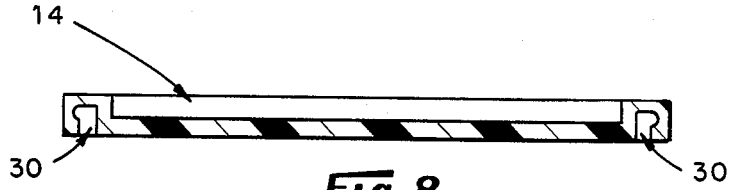
FIG. 8 is a cross-sectional view of the lid of FIG. 1 taken along line 8—8.
Figure 9:
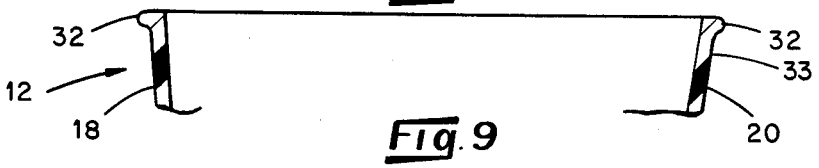
FIG. 9 is a fragmentary cross-sectional view of the container of FIG. 1 taken along line 9—9.

The container 12 depicted in FIG. 1 is a small, lidded kitchen container preferably made of flexible plastic. As shown in cross-section in FIG. 8, a peripheral groove 30 in the lid 14 receives the rim 26 to sealingly secure the lid 14 to the container 12. As shown in FIG. 1, and in more detail in FIG. 9, the container 12 includes a bead 32 adjacent to the rim 26 on the outside of the container 12 which serves to secure the rim 26 of the container 12 into the peripheral groove 30 of the lid 14 and to form a seal. The peripheral groove 30 is shaped and dimensioned to matingly receive the rim 26 and bead 32. In addition, the container 12 has a thickened reinforcement area 33 adjacent to the rim 26 to provide the rim 26 with more rigidity. It is to be understood that while the container depicted is a small, lidded kitchen container, the invention may be embodied in various forms such as larger containers for industrial shipping and storage, specimen containers for scientific and medical use, containers for use in manufacturing processes, cookware and many other forms. Various types of attachment mechanisms between the lid 14 and the container 12 may be employed with the container of the present invention.

Figure 2:
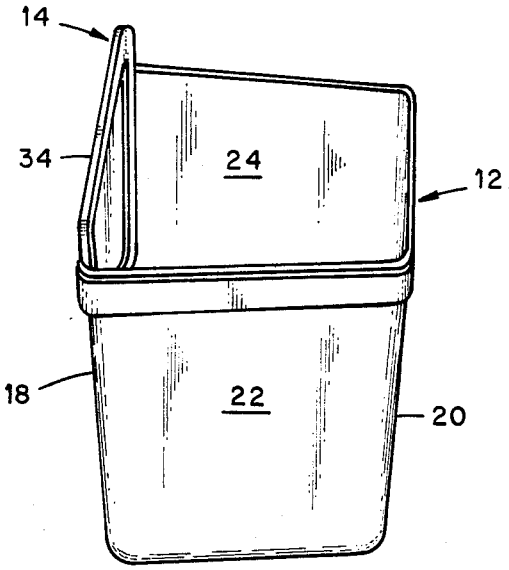
FIG. 2 is a perspective view of the container of FIG. 1 with the lid shown inserted into the container along and against the wall defining the long parallel side of the rim.
Figure 6:
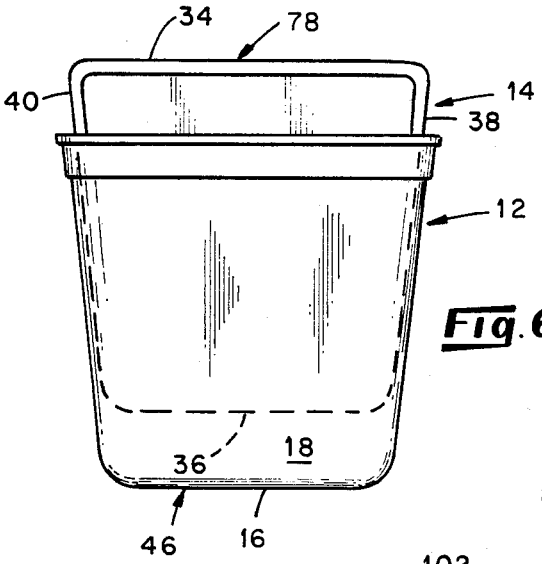
FIG. 6 is an end elevational view of the container of FIG. 1 showing the lid inserted into the container as in FIG. 2 with the inserted portion of the lid being shown in broken lines.

In FIGS. 2 and 6, a container according to the present invention is shown with the lid 14 inserted into the container 12. As shown and as will be described in more detail hereinafter, the container 12 and lid 14 are dimensioned and configured so that the lid 14 may be inserted into the interior of the container 12 for storage along and against the first end wall 18. As shown in FIG. 6, the lid 14 is preferably insertable a substantial distance into the container 14 and covers a substantial portion of the inside of first end wall 18.

Figure 3:
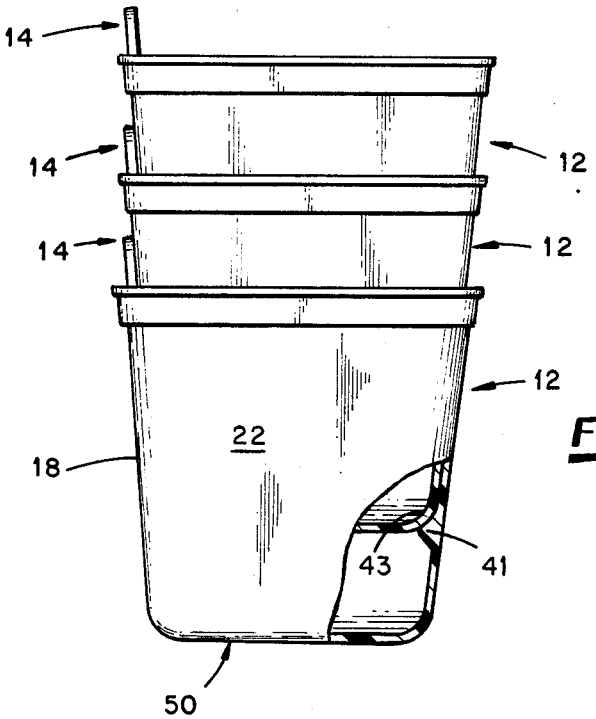
FIG. 3 is a partially broken away side elevational view of a plurality of the containers with lids inserted as in FIG. 2 shown in a nested stack of like containers and lids.

FIG. 3 shows a nested stack of a plurality of like containers and like lids according to the present invention as arranged in FIG. 2. As shown and as will be described in more detail hereinafter, the containers 12 and lids 14 are dimensioned and configured for nested stacking with a container 12 being inserted into the interior of the container 12 below it with the lids 14 being sandwiched between adjacent first end walls 18. Preferably, the containers 12 and lids 14 are dimensioned and shaped to provide for the insertion of a substantial portion of a container 12 into the container 12 below it.

As further shown in the broken away portion of FIG. 3, a ridge 41 is preferably formed on the inside of the second end wall 20 of the containers to provide a stop surface 43. The stop surface 43 operates to limit the distance of insertion of a container 12 into the next lower container so that adjacent containers will not become lodged together and to form an even nested stack.

Figure 4:
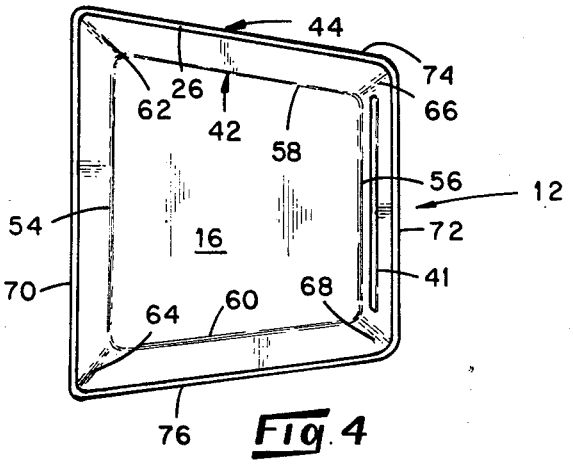
FIG. 4 is a top plan view of the container of FIG. 1.
Figure 5:
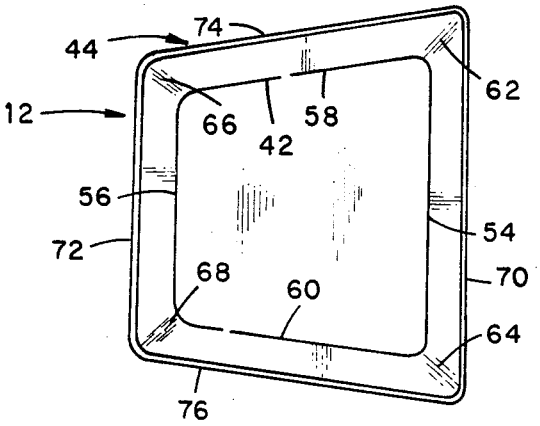
FIG. 5 is a bottom plan view of the container of FIG. 1.
Figure 13:
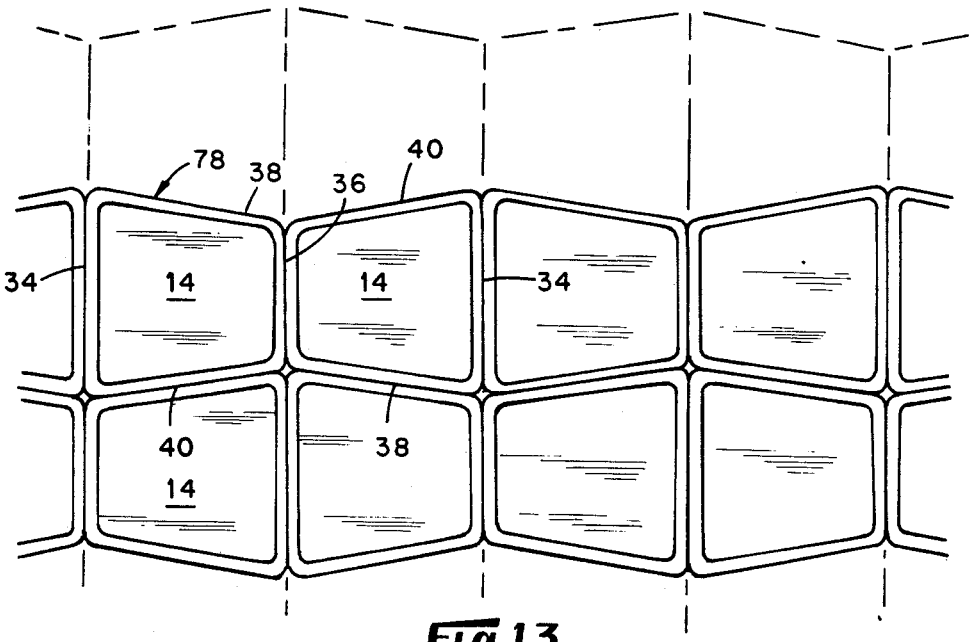
FIG. 13 is a top plan view of a plurality of containers as arranged in of FIG. 12.

Referring to FIG. 1, 6 and 13 it may be seen that the lid 14 has a generally trapezoidal shape defined by long and short parallel opposed lid edges 34 and 36, respectively, and first and second converging opposed lid edges 38 and 40, respectively. The lid 14 thus defines a trapezoid which may be referred to as a lid trapezoid 78. Referring to FIGS. 4 and 5 showing the container 12 alone, it is seen that the rim 26, which is proportioned to engage the lid 14, is also shaped generally as a trapezoid and defines a rim trapezoid 44 having similar dimensions and shape to the lid trapezoid 78. The rim 26 is defined by the upper ends of the four walls by long and short parallel opposed rim edges 70 and 72, respectively, which are the upper ends of the first and second end walls 18 and 20, respectively, and first and second converging opposed rim edges 74 and 76, respectively, which are the upper ends of the first and second side walls 22 and 24, respectively.

In the container depicted in FIGS. 1–9, the corners of the container 12 adjacent to the bottom 16 and the edges formed by the junctions of the interconnected walls and the junctions of the walls and bottom are rounded to facilitate cleaning, for strength, and for resistance to wear. Consequently, the term trapezoid as used in this application is intended to refer to the approximate geometric shape defined by various portions of the container defining long and short generally parallel opposed sides, and two converging opposed sides. Actual geometric shapes may have rounded portions at the intersections of the sides or other features as shown and described. For example, all the intersections of adjacent sides of the lid trapezoid 78 and the rim trapezoid 44 are rounded as shown and as will be described in more detail hereinafter.

The end walls 18 and 20 and the side walls 22 and 24 of the container 12 converge inwardly from the rim 26 to the bottom 16 to a sufficient degree to permit one container 12 to be nested within another container 12 as shown in FIG. 3. As is known in the art, the angle of convergence is to be varied depending upon the wall thickness and upon the closeness of the nesting desired for a particular application. As shown in the drawings, the angle of convergence for each of the walls with respect to the plane defined by the rim 26 is preferably approximately equal. The angles for the respective sides may be different as is necessary and to impart desired properties provided the container 12 otherwise is within the scope of the invention as described and claimed.

As discussed previously, the upper ends of the first and second side walls 22 and 24 define the first and second converging opposed rim edges 74 and 76 and therefore the side walls 22 and 24 converge inwardly from the first end wall 18 to the second end wall 20. The side walls 22 and 24 also converge from the rim 26 to the bottom 16 to a sufficient degree to permit nested stacking. The degree of convergence is such that the lid 14 is insertable into the container 12 along and against the first end wall 18. Preferably as shown in FIG. 6, the angles between the first and second converging opposed lid edges 38 and 40 and the long parallel lid edge 34 are equal and are generally the same as the angles of convergence of the first and second side walls 22 and 24 in relation to a plane defined by the rim 26. If desired, and to the degree possible without hampering the nesting characteristics of the container 12, the convergence of the first and second side walls 22 and 24 is somewhat less than the convergence of the first and second converging opposed lid edges 38 and 40 so that the lid is insertable farther into the container.

Preferably, the distance between the long and short parallel opposed edges 34 and 36 of the lid 14 is not substantially greater than the depth of the container from the rim 26 to the bottom 16 so that a large portion of the lid 14 does not extend above the rim 26 when the lid 14 is inserted into the container 12. For example, if a container is about four inches deep, the lid preferably is not greater than about five inches in length. Most preferably, the length of the lid 14 is about the same as the depth of the container 12.

Preferably, the first and second end walls 18 and 20 and the bottom 16 have a trapezoidal configuration. In some embodiments it is desirable for the rim 26 to slant downwardly from the long parallel rim edge 70 to the short parallel rim edge 72. In the form of the invention shown in the drawings, the bottom 16, and the four walls 18, 20, 22 and 24 are also all configured to define trapezoids so that the rim 26 is generally parallel to the bottom. Most preferably, the first and second end walls 18 and 20, the lid 14, the rim 26, and the bottom 16 define isosceles trapezoids as shown. In addition, the first end wall 18 is dimensioned to generally correspond to the dimensions of the lid 12 as is preferable.

Figure 7:
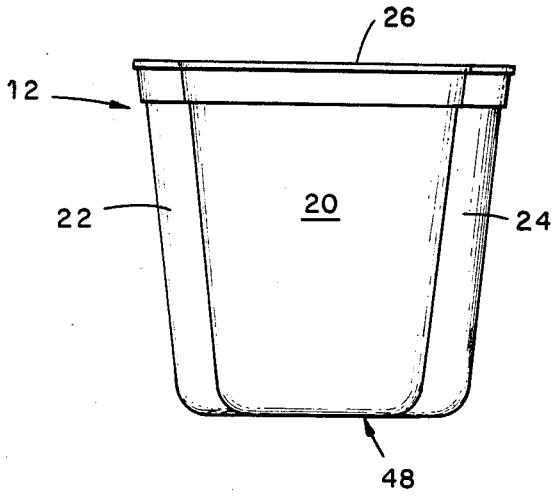
FIG. 7 is an opposite end view of the container of FIG. 1.

Referring again to FIGS. 4 and 5 showing the preferred embodiment of the invention, it may be seen that the bottom 16 defines a bottom trapezoid 42. FIG. 6 shows that the first end wall 18 defines a first end wall trapezoid 46 and FIG. 7 shows that the second end wall 20 defines a second end wall trapezoid 48. FIG. 3, shows an elevational view of the first side wall 22. The second side wall 24 has the same dimensions and shape as the first side wall 22 and the first and second side walls define two side wall trapezoids 50.

As shown in FIGS. 4 through 7, it is seen that the edges of the bottom 16 defining the bottom trapezoid 42 all form the short parallel side of the trapezoids defined by the four walls of the base member 12. A first end bottom edge 54 defines the long parallel side of the bottom trapezoid 42 and the short parallel side of the first end wall trapezoid 46. A second end bottom edge 56 provides the short parallel side for the bottom trapezoid 42 and the short parallel side for the end wall trapezoid 48. A first side bottom edge 58 and a second side bottom edge 60 provide the converging opposed sides of the bottom trapezoid 42 and form the short parallel sides of the side wall trapezoid 50.

First end wall edges 62 and 64 define the converging opposed sides of the first end wall trapezoid 46 and define one of the converging opposed sides of each of the side wall trapezoids 50. The second end wall edges 66 and 68 form the two opposed converging sides of the second end wall trapezoid 48 and provide the other two other converging sides of the side wall trapezoids 50.

The long parallel rim edge 70 provides the long parallel side of the first end wall trapezoid 46 and the long parallel side of the rim trapezoid 44. The short parallel rim edge 72 provides the short parallel side of the rim trapezoid 44 and the long parallel side of the second end wall trapezoid 48. A first and second converging rim edges 74 and 76, respectively, provide the long parallel side for the side wall trapezoids 50. The rim edges 70, 72, 74 and 76 are configured as previously described and shown in detail in FIG. 9 to provide for attachment of the container 12 to the lid 14.

The bottom edges 54, 56, 58 and 60 and wall edges 62, 64, 66 and 68 are all preferably rounded as shown to facilitate cleaning for strength, and for resistance to wear. To permit greater insertion of the lid 14 into the container 12 with the lid being along and against the first end wall 18, the first end wall edges 62 and 64 are preferably only slightly rounded. Consequently, as shown in FIG. 4, the intersections of the converging rim edges 74 and 76 with the long parallel rim edge 70 are preferably only slightly rounded. To correspond, the intersections of the converging lid edges 38 and 40 with the long parallel lid edge 34 are preferably only slightly rounded.

Figure 11:
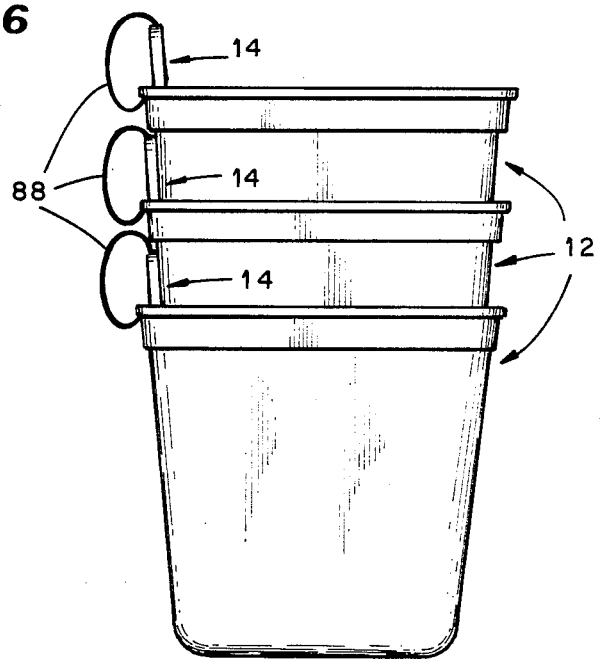
FIG. 11 is a side view of a plurality of containers embodying another form of the present invention having a hinged connection between the container and the lid showing the containers and lids stacked in a nested arrangement.

FIG. 11 shows a plurality of like containers as previously described and shown in the drawings together with the lids further including a ribbon hinge 88 connecting between an upper area of the first end wall and the long parallel lid end edge 80. Alternately, the hinge 88 may be attached to the top of the lid 14. The hinge 88 is preferably plastic of the same type as the container 12 so that it may be integrally secured to the lid 14 and container 12 with the container 12, lid 14 and hinge 88 being molded as a unit. Alternately, other types of hinges may be used such as a nylon ribbon which is appropriately secured to the container 12 and lid 14 with adhesives or other such means. The ribbon hinge 88 is sufficiently long to permit the lid 14 to be removed from the top of the container and inserted into the containers as shown in the drawings. The hinge 88 is sufficiently wide to prevent the lid 14 from being greatly twisted with respect to the container 12. If desired, a plurality of hinges may be employed.

Figure 10:
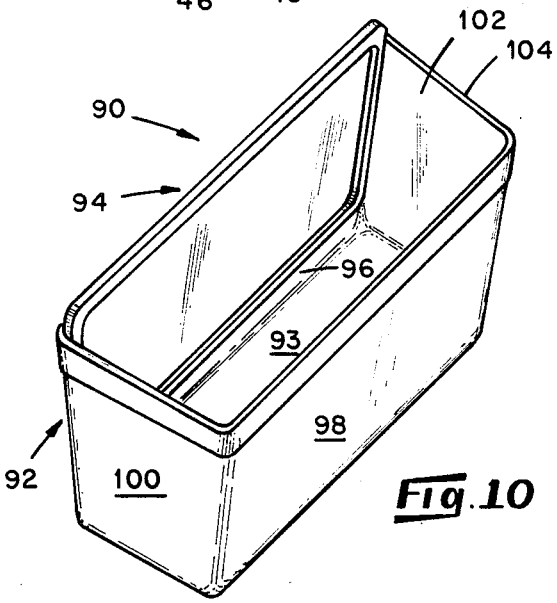
FIG. 10 is a perspective view of another embodiment of a container according to the present invention with a lid shown inserted into the container along and against the wall defining the long parallel side of the rim.

Referring now to FIG. 10 there is shown another embodiment of a container according to the present invention which has been designated by the numeral 92. The container 92 is appropriately dimensioned to hold, for example, an ordinary loaf of bread. The container 92 has a trapezoidal-shaped lid 94 for closing the container 92. The container 92 is similar to the container 12 having an elongated bottom 93, elongated first and second end walls 96 and 98, respectively, and first and second side walls 100 and 102, respectively. The walls collectively define a rim 104 which is proportioned to engage the lid 94. As described for the container 12 and lid 14, the four walls 96, 98, 100 and 102 converge from the rim 104 to the bottom 93 and the side walls 100 and 102 converge so that the lid member 106 is insertable into the base member 92 along and against the first end wall 96 as shown in FIG. 10. In addition, containers and lids as arranged in FIG. 10 are stackable in a nested arrangement similar to the container 10 as shown in FIG. 3.

In use, containers of the present invention are used generally in the same manner as known containers for the same or similar function. When one container is being stored, the lid 14 is inserted into the container 12 as shown in FIG. 2 so that the lid 14 is not separated from the container during storage. A plurality of containers 12 and lids 14 are stackable in a nested arrangement for storage as shown in FIG. 3. Other embodiments of the present invention such as the container of FIG. 10 may be handled and stored similarly. The container according to the present invention thus eliminates problems such as the possibility for misplacing lids for a particular size container, confusing the lids for one type of container with lids for other types of containers. At the same time, the container of the present invention minimizes the space required for storage and provides simplified handling since a plurality of lids and containers may be handled as a unit without the need for other means to secure the lids to the containers.

The embodiment of the present invention as shown in FIG. 11 further including a ribbon hinge is usable in the same manner as the container shown in FIGS. 1 through 6. Since the container as shown in FIG. 11 further includes a ribbon hinge 88, the lid is always attached to the container and the problems associated with separate lids for the containers are entirely eliminated. At the same time, the containers are readily stackable in a space-saving, nested arrangement.

Figure 12:
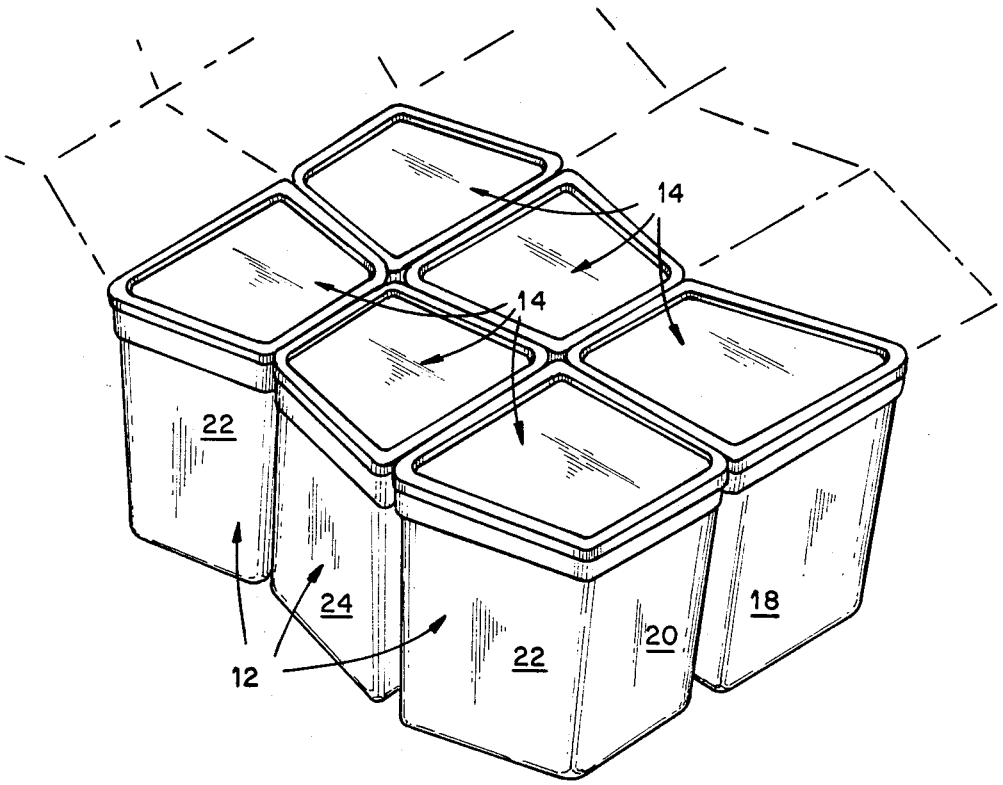
FIG. 12 is a perspective view showing a plurality of containers of FIG. 1 shown with the lids closing the containers and being arranged in a space-saving arrangement on a support surface.

The containers of the present invention thus provide an improved container with improved characteristics for storage and handling. As shown in FIGS. 12 and 13 the containers occupy only a small amount of additional space when in use when compared with known containers with lids having a rectangular configuration. As shown, containers adjacent to one another can be rotated 180° so that the first end wall 18 is in contact with the first end wall 18 of another container and so that the second end wall 20 is in contact with the second end wall 20 of another container. The first side wall 22 is adjacent to a second side wall 24 of another container and the second side wall is adjacent to a first side wall of another container. In such an arrangement, there is no space lost between containers when compared to rectangular containers.

Although particular embodiments of the present invention have been described in the foregoing detailed description, it will be understood that the invention is capable of numerous modifications without departing from the spirit of the invention.

I claim:

1. In combination, a nesting open-topped container and lid, said lid being generally planar and having edges which generally define a trapezoid having long and short generally parallel opposed sides and two converging opposed sides, said open-topped container having a rim proportioned to engage said lid which generally defines a trapezoid having long and short generally parallel opposed sides and two converging opposed sides, a bottom, and four generally planar walls being interconnected to one another, the upper ends of said walls defining said rim, the distance between the long and short parallel sides of said lid and the distance between the long and short parallel sides of said rim being not substantially greater than the depth of said container from said rim to said bottom, said walls of said container converging inwardly from said rim to said bottom with a degree of convergence sufficient to permit said container to nest within a similarly shaped container, the degree of convergence of said walls which define the opposed converging sides of said rim being such that said lid is insertable into said container along and against the wall which defines the long parallel side of said rim with said short parallel side of said lid being adjacent to said bottom of said container, whereby, a plurality of said containers and lids are stackable in a nested stack with said lids being sandwiched between adjacent walls defining the long parallel side of said rim.

2. The container of claim 1 wherein said wall defining the long parallel side of said rim and the wall defining the short parallel side of said rim both are generally trapezoidal in shape.

3. The container of claim 2 wherein the walls defining the two converging opposed sides of said rim both are generally trapezoidal in shape.

4. The container of claim 1 wherein said lid, said rim, said walls defining the long and short parallel sides of said rim and said bottom are generally in the shape of isosceles trapezoids.

5. The container of claim 1 further comprising hinge means for hingedly attaching said lid adjacent the long parallel side of said lid to said wall defining the long parallel side of said rim.

6. The container of claim 1 further comprising stop means on the wall defining short parallel side of said rim for limiting the amount of nested insertion of a container within a similarly shaped container.

* * * * *